US010155238B2

(12) United States Patent
Mitchell

(10) Patent No.: US 10,155,238 B2
(45) Date of Patent: Dec. 18, 2018

(54) PROGRAMMABLE LOCKING DISPENSER AND METHOD OF USE

(71) Applicant: Betco Corporation, Bowling Green, OH (US)

(72) Inventor: John E. Mitchell, Temperance, MI (US)

(73) Assignee: Betco Corporation, Bowling Green, OH (US)

( * ) Notice: Subject to any disclaimer, the term of this patent is extended or adjusted under 35 U.S.C. 154(b) by 0 days.

(21) Appl. No.: 15/209,814

(22) Filed: Jul. 14, 2016

(65) Prior Publication Data

US 2017/0028420 A1 Feb. 2, 2017

Related U.S. Application Data

(60) Provisional application No. 62/197,122, filed on Jul. 27, 2015.

(51) Int. Cl.
*B05B 11/00* (2006.01)
*A47K 5/12* (2006.01)

(52) U.S. Cl.
CPC ..... *B05B 11/3059* (2013.01); *A47K 5/1217* (2013.01)

(58) Field of Classification Search
CPC ..... A47K 5/1217
USPC ..... 700/231–244
See application file for complete search history.

(56) References Cited

U.S. PATENT DOCUMENTS

| | | | | |
|---|---|---|---|---|
| 4,351,799 | A | 9/1982 | Gross et al. | |
| 6,267,297 | B1 | 7/2001 | Contadini et al. | |
| 6,619,512 | B1 | 9/2003 | Sayers et al. | |
| 7,066,356 | B2 | 6/2006 | Schuman et al. | |
| 7,086,567 | B1 | 8/2006 | Ciavarella et al. | |
| 7,410,615 | B2 | 8/2008 | Krug et al. | |
| 7,621,426 | B2 | 11/2009 | Reynolds et al. | |
| 7,770,782 | B2 * | 8/2010 | Sahud | G08B 21/245 235/375 |
| 7,774,096 | B2 * | 8/2010 | Goerg | A47K 10/3845 221/2 |
| 8,009,015 | B2 * | 8/2011 | Sayers | A47K 5/1217 340/5.24 |
| 8,158,083 | B2 | 4/2012 | Krug et al. | |

(Continued)

*Primary Examiner* — Timothy R Waggoner
(74) *Attorney, Agent, or Firm* — MacMillan, Sobanski & Todd, LLC

(57) ABSTRACT

A programmable locking dispenser is provided and includes a reservoir configured to store material and release the material upon demand. A pump/valve mechanism is configured for fluid connection with the reservoir. An output structure is configured for fluid connection with the pump/valve mechanism. A controller is configured to generate and send dispensing signals to the pump/valve mechanism. The controller is further configured to store lock and unlock codes. A sensing mechanism is configured to generate activation signals upon an occurrence of an activating event and further configured to convey the activation signals to the controller. An input device is configured to receive programming signals and convey the programming signals to the controller. The controller is further configured to selectively lock and unlock the dispenser such that in a locked mode, the dispenser is disabled from use and in a locked mode, the dispenser is enabled for use.

17 Claims, 4 Drawing Sheets

(56) References Cited

U.S. PATENT DOCUMENTS

| | | | | |
|---|---|---|---|---|
| 8,230,888 | B2 | 7/2012 | Crossdale et al. | |
| 8,485,395 | B2 | 7/2013 | Ciavarella et al. | |
| 8,558,701 | B2 * | 10/2013 | Wegelin | A47K 5/1217 340/573.1 |
| 8,708,198 | B2 | 4/2014 | Proper et al. | |
| 9,101,676 | B2 | 8/2015 | Hoppe et al. | |
| 2005/0103799 | A1 * | 5/2005 | Litterst | B67D 1/102 222/55 |
| 2006/0243740 | A1 * | 11/2006 | Reynolds | A47K 5/1217 222/52 |
| 2010/0117836 | A1 * | 5/2010 | Seyed Momen | G01S 1/70 340/573.1 |
| 2013/0200097 | A1 * | 8/2013 | Yang | A47K 5/1217 222/52 |
| 2015/0022361 | A1 * | 1/2015 | Gaisser | A47K 5/1217 340/573.1 |
| 2016/0216714 | A1 * | 7/2016 | Wegelin | A47K 5/1217 |

* cited by examiner

PROGRAMMABLE LOCKING DISPENSER AND METHOD OF USE

RELATED APPLICATIONS

This application claims priority from U.S. Provisional Patent Application No. 62/197,122 filed Jul. 27, 2015, the disclosure of which is incorporated herein by reference in its entirety.

BACKGROUND

Dispensing devices are used in many facilities and industries for storing and dispensing all forms of materials including liquids, solids and powders. One non-limiting example is a dispensing device for dispensing hand cleaning chemicals.

The complexity of dispensing devices can range from manually-operated, simple enclosures to enclosures employing cutting-edge sensors configured to dispense materials upon the sensed presence of a person or object. In certain instances, dispensing devices can be configured to sense and approve of an inserted container or reservoir of dispensing material prior to dispensing. Various forms of sensing technology can used for sensing and approving of an inserted container, including the non-limiting examples of infrared technology, bar code technology, near field technology, optical technology or other technologies to ensure the inserted container of dispensing material is approved for application in the dispensing device.

In certain instances, manufacturers of dispensing devices market the dispensing devices through distributers. The distributers, in turn, market the dispensing devices to various end-user facilities, such as the non-limiting examples of factories, hospitals, warehouses, schools, offices and buildings. The end-user facilities position the dispensing devices for use by the facility occupants. It is hoped by the manufacturers that the end-user facilities will replace empty or spent containers of dispensing material with new containers purchased from the manufacturers. One issue faced by the dispensing industry is the occurrence that the end-user facilities replace empty or spent containers of dispensing materials with replacement containers purchased from suppliers other than the original manufacturers.

It would be advantageous if dispensing devices could be improved.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the programmable locking dispenser.

The above objects as well as other objects not specifically enumerated are achieved by a programmable locking dispenser. The programmable locking dispenser includes a reservoir configured to store dispensing material and release the dispensing material upon demand. A pump/valve mechanism is configured for fluid connection with the reservoir. An output structure is configured for fluid connection with the pump/valve mechanism. A controller is configured to generate and send dispensing signals to the pump/valve mechanism. The controller is further configured to store lock and unlock codes. A sensing mechanism is configured to generate activation signals upon an occurrence of an activating event and further configured to convey the activation signals to the controller. An input device is configured to receive programming signals and convey the programming signals to the controller. The controller is further configured to selectively lock and unlock the dispenser such that in a locked mode, the dispenser is disabled from use and in a locked mode, the dispenser is enabled for use.

There is also provided a method of programming and operating a programmable locking dispenser. The programmable locking dispenser includes a reservoir, a pump/valve mechanism, an output structure, a controller, a sensing mechanism and an input device. The method includes the steps of shipping the dispenser in an unlocked mode to enable input of unlock codes and specific locking events, programming the dispenser to include an unlock codes and desired specific locking events and locking of the dispenser to disable use following a specific locking event.

Various objects and advantages of the programmable locking dispenser will become apparent to those skilled in the art from the following detailed description, when read in light of the accompanying drawings.

DETAILED DESCRIPTION

The programmable locking dispenser will now be described with occasional reference to specific embodiments. The programmable locking dispenser may, however, be embodied in different forms and should not be construed as limited to the embodiments set forth herein. Rather, these embodiments are provided so that this disclosure will be thorough and complete, and will fully convey the scope of the programmable locking dispenser to those skilled in the art.

Unless otherwise defined, all technical and scientific terms used herein have the same meaning as commonly understood by one of ordinary skill in the art to which the programmable locking dispenser belongs. The terminology used in the description of the programmable locking dispenser herein is for describing particular embodiments only and is not intended to be limiting of the programmable locking dispenser. As used in the description of the programmable locking dispenser and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the programmable locking dispenser. Notwithstanding that the numerical ranges and parameters setting forth the broad scope of the programmable locking dispenser are approximations, the numerical values set forth in the specific examples are reported as precisely as possible. Any numerical values, however, inherently contain certain errors necessarily resulting from error found in their respective measurements.

In accordance with illustrated embodiments, the description and figures disclose a programmable locking dispenser (hereafter "dispenser") and a method of using the dispenser. Generally, the dispenser includes one or more programmable devices configured to selectively lock and unlock use of the dispenser. In a locked orientation, the dispenser is disabled or prevented from use. In an unlocked orientation, the dispenser is enabled or allowed for use. The term "dispenser", as used herein, is defined to mean any structure, mechanism or device configured for storing and dispensing a material.

Figure 1:
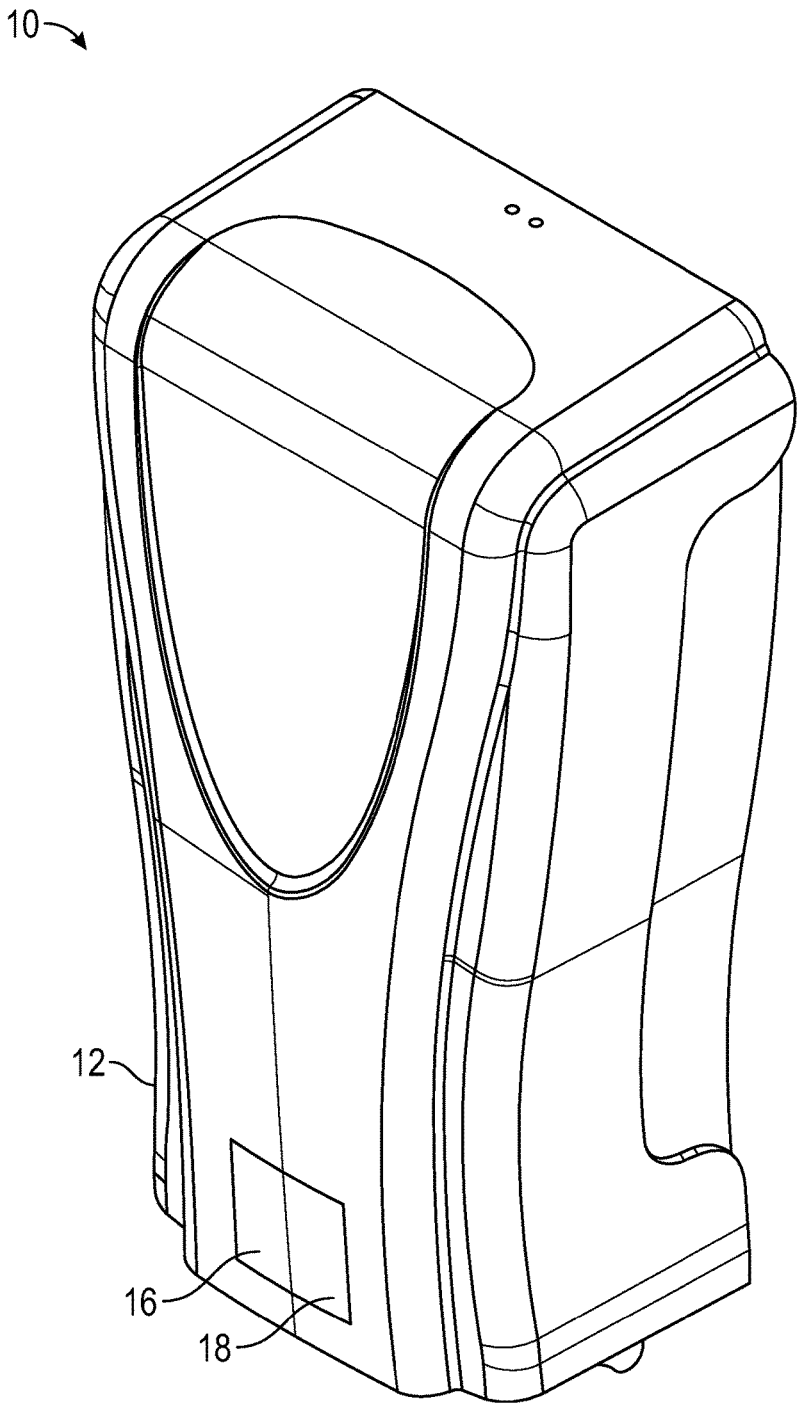
FIG. 1 is a perspective view of a programmable locking dispenser.
Figure 2:
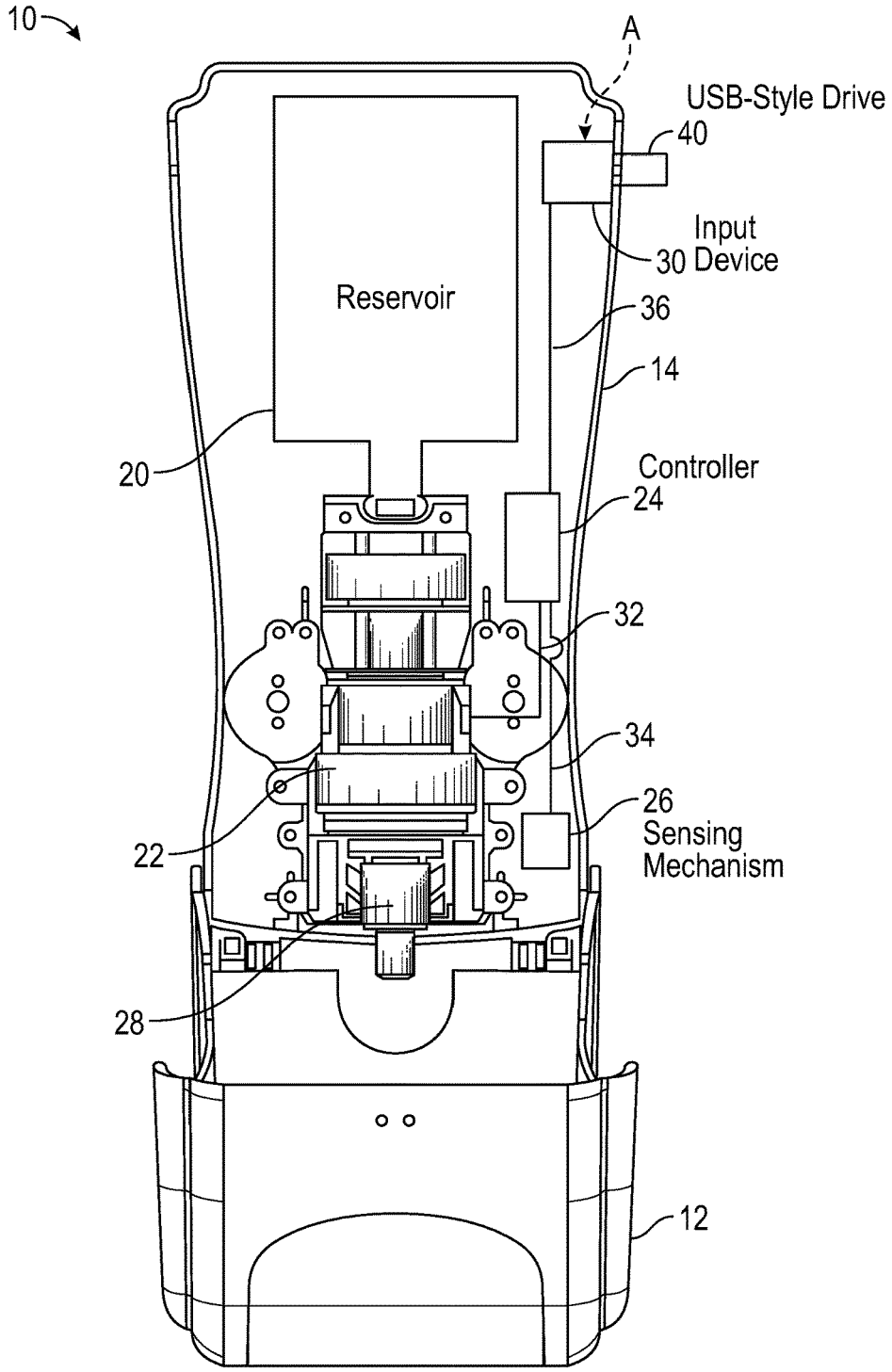
FIG. 2 is a front view, in elevation, of the programmable locking dispenser of FIG. 1 illustrated with a cover in an open position.

Referring now to FIGS. 1 and 2, one non-limiting embodiment of a dispenser is shown schematically at 10. The dispenser 10 is configured to store and dispense dispensable materials, such as for example liquids, solids and powders. The dispenser 10 includes a dispenser cover 12, configured to enclose a dispenser base 14. The dispenser cover 12 is rotatable from a closed orientation as shown in FIG. 1 to an open orientation as shown in FIG. 2. In the closed orientation, the dispenser cover 12 is configured to enclose the dispenser base 14 and various components mounted to the dispenser base 14. In the open orientation, the dispenser base 14 is visually exposed.

Referring now to FIG. 1, the dispenser cover 12 includes an aperture 16 configured to allow exposure of an optional display device 18. The display device 18 will be discussed in more detail below. The dispenser cover 12 can have any desired shape, contours, size or configuration and can be made from any desired material or materials sufficient to cover the dispenser base 14 and the components mounted to the dispenser base 14. In certain embodiments, the dispenser cover 12 can be configured to support various components and assemblies (not shown).

Referring now to FIG. 2, the dispenser 10 also includes a container or reservoir, shown schematically at 20, a pump/valve mechanism 22, a controller shown schematically at 24, a sensing mechanism shown schematically at 26, an output structure 28 and an input device schematically at 30.

Referring again to FIG. 2, in certain embodiments, the dispenser 10 can include an internal power supply (not shown) and in other embodiments, the dispenser 10 can be powered from sources external to the dispenser 10. The internal and external power sources are not shown in FIG. 2 for purposes of clarity.

Referring again to FIG. 2, the reservoir 20 is configured to store dispensing material (not shown) and release the dispensing material upon demand. In certain embodiments, the reservoir 20 can be a pouch or bag. Alternatively, the reservoir 20 can be any structure, such as for example a canister or collapsing semi-rigid bottles, configured to store and release dispensing material. The dispensing material can be any desired material and can have any desired form. Non-limiting examples of dispensing material forms include liquids, solids, powders and aerosols. Non-limiting examples of dispensing materials include skin cleaners, hair washes, skin lotions, detergents, softeners, bleaches, sanitizers, degreasers, finishes, strippers, glass cleaners, disinfectants and the like.

Referring again to FIG. 2, the pump/valve mechanism 22 fluidly connects the reservoir 20 with the outlet structure 28. The pump/valve mechanism 22 is electrically connected to the controller 24 via connector 32. In certain instances, the pump/valve mechanism 22 receives an electrical activation signal from the controller 24 and releases a metered amount of dispensing material from the reservoir 20 to the outlet structure 28. Pump/valve mechanisms 22 are known in the art and any desired pump/valve mechanism 22 can be used.

Referring again to FIG. 2, the outlet structure 28 is connected to the pump/valve mechanism 22 and includes an aperture (not shown), through which the dispensing material exits the dispenser 10. The outlet structure 28 can have any desired shape, size and configuration sufficient to allow dispensing material to flow from the pump/valve mechanism 22 and exit the dispenser 10.

Referring again to FIG. 2, the controller 24 is in electrical communication with the sensing mechanism 26 via connector 34. Optionally, the controller 24 is in electrical communication with the display device 18 via another connector (not shown). The controller 24 is configured for several functions. First, the controller 24 is configured to receive programming signals from the input device 30 via electrical connector 36. The programming signals received from the input device 30 can include locking codes for disabling operation of the dispenser 10 and unlocking codes for enabling operation of the dispenser 10. The programming signals will be discussed in more detail below. Second, the controller 24 is configured to store the locking and unlocking codes for subsequent use. Storage of the locking and unlocking codes is accomplished by a memory (not shown), contained within the controller 24. The memory can have any desired structure, sufficient to store the locking and unlocking codes for subsequent use. Third, the controller 24 is configured to receive activation signals from the sensing mechanism 26 or other signal generators, such as the non-limiting example of a manually operated actuator device (not shown). Fourth, upon receiving the activation signals, the controller 24 is configured to compare the activation signal with the pre-programmed codes for unlocking or locking the operation of the dispenser 10 contained within the controller 24. The controller 24 is also configured to generate and send dispensing signals to the pump/valve mechanism 22 upon receipt of an activation signal with the dispenser 10 in an unlocked mode. Conversely, the controller 24 is configured to prevent sending of dispensing signals to the pump/valve mechanism 22 upon receipt of an activation signal with the dispenser 10 in a locked mode. Finally, as the pump/valve mechanism 22 is releasing the dispensing material, the controller 24 can be configured to simultaneously generate and send signals to the optional display device 18. The optional display device 18 can, in turn, display approved user messages such as for example hand washing instructions.

Referring again to the embodiment illustrated in FIG. 2, the controller 24 is a microprocessor-based device sufficient to provide the functions discussed above. However, in other embodiments the controller 24 can be any device sufficient to provide the functions discussed above. Optionally, the controller 24 can be equipped with visual and/or audio displays configured to indicate the condition or status of various modes or operations of the controller 24 and/or dispenser 10. In one example, the controller 24 can include status lights indicating an unlocked or locked operating mode. Examples of suitable visual and/or audio displays include display screens, status lights, beeps and buzzers.

Referring again to FIG. 2, the sensing mechanism 26 is configured to generate activation signals upon the occurrence of an activating event. Non-limiting examples of activation events can include sensing the presence of a person or object. The generated activation signals are conveyed to the controller 24 via connector 34. Sensing mechanisms are known in the art and any desired sensing mechanism can be used.

Referring again to FIG. 2, the input device 30 can be configured for several functions. In certain instances, the input device 30 can be configured to wirelessly receive programming signals from devices located remotely from the dispenser 10, as indicated by schematic direction arrow A. Non-limiting examples of remote devices include wireless satellite communications, remote computer/internet-based devices and remote handheld electronic devices, such as for example smartphones and tablets. Upon receipt of the programming signals, the input device 30 is configured to convey the programming signals to the controller 24. In other instances, the input device 30 is configured to generate programming signals and convey the generated programming signals to the controller 24. In these instances, the programming signals can be generated by structures such as for example, keypads, numeric pads, touch screens and the like. In still other instances, the input device 30 can be configured for physical connection to other structures and devices containing programming signals. In one non-limiting example, the input device 30 is configured to communicate with a mobile storage device having a USB-style connector, shown schematically at 40. In another example, the input device 30 can be configured for physical connection to handheld electronic devices, such as for example smartphones and tablets. The mobile storage device 40 can include programming signals that can be received by the input device 30 and subsequently conveyed to the controller 24 by the input device 30. The mobile storage device 40 advantageously provides ease of use and cost-reducing possibilities.

While the input device 30 shown in FIG. 2 is illustrated as a distinct structure spaced apart from the controller 24, it is within the contemplation of the dispenser 10 that the input device 30 can be integral to the controller 24.

Figure 3:
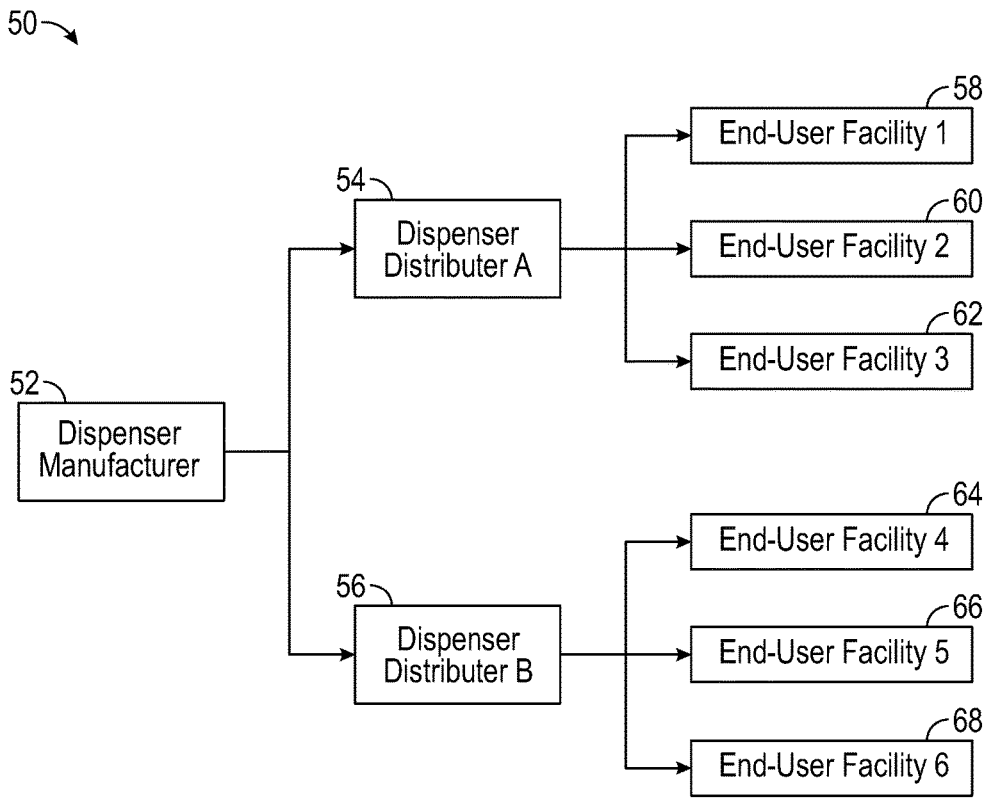
FIG. 3 is a flow chart illustrating one embodiment of a distribution of the programmable locking dispenser of FIG. 1.

Referring now to FIG. 3, manufacturers of dispensers 10 often market the dispensing devices 10 through distributers. One embodiment of a method for distribution of the dispensers 10 from a dispenser manufacturer to an end-user facility is illustrated at 50. In this method, a dispenser manufacturer 52 markets dispensers (not shown) to distributor A and distributor B, labeled respectively as 54, 56. While the illustrated embodiment shows a quantity of two (2) distributors 54, 56, it should be appreciated that in other embodiments, any desired quantity of distributors can be used. The distributors 54, 56 in turn market the dispensers 10 to end-user facilities 1-6, labeled respectively as 58, 60, 62, 64, 66 and 68. Non-limiting examples of end-user facilities include factories, hospitals, warehouses, schools, offices, buildings and the like.

Referring again to the embodiment shown in FIG. 3, each of the dispenser distributers 54, 56 is illustrated as marketing to a quantity of three (3) end-user facilities. However, in practice, the dispenser distributors 54, 56 can market dispensers 10 to any desired quantity of end-user facilities. After receiving the dispensers 10, the end-user facilities locate the dispensers 10 for use by the facility occupants.

While the embodiment illustrated in FIG. 3 shows the dispenser manufacturer 52 marketing dispensers 10 to the distributers 54, 56 and the distributers 54, 56 marketing to the end-user facilities 58, 60, 62, 64 66 and 68, it should be appreciated that in other embodiments, the marketing and distribution of the dispensers 10 can be practiced in other manners and forms without departing from the scope of the programmable locking dispenser 10, such as for example marketing and distribution of the dispensers 10 directly to the end-user facilities by the manufacturer.

Figure 4:
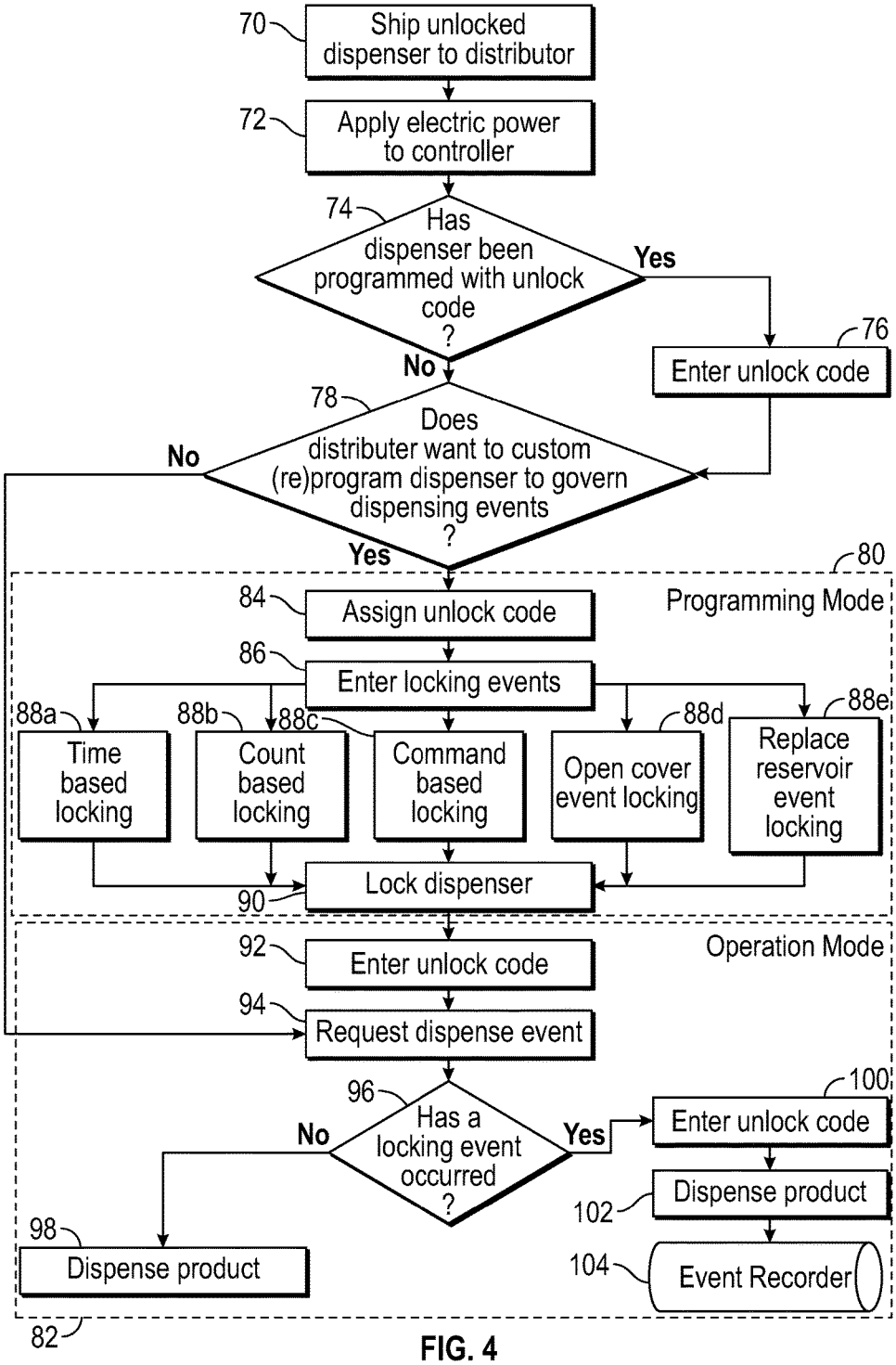
FIG. 4 is a flow chart illustrating a method of programming and operating the programmable locking dispenser of FIG. 1.

As described above, the dispenser 10 includes one or more programmable controllers 24 configured to selectively and electronically unlock the dispenser, thereby enabling use of the dispenser 10. The one or more programmable controllers 24 are also configured to selectively and electronically lock the dispenser, thereby disabling use of the dispenser 10. Referring now to FIG. 4, the programming and operation of the dispenser 10 will be described. In an initial step 70, the dispenser 10 is shipped to a distributor with the dispenser 10 in an unlocked mode. That is, the dispenser 10 is shipped to the distributer in a mode such that the controller 24 is configured to permit operation of the dispenser 10. While step 70 indicates shipment of the dispenser 10 to a distributer, it should be appreciated that step 70 can include shipment of the dispenser 10 directly to an end user in an unlocked mode. In a next step 72, the distributer applies electrical power to the controller 24 within the dispenser 10. The electrical power can have any desired form, including the non-limiting examples of an internal battery (not shown) or external power sources (not shown). The electrical power can have any form, voltage or amperage sufficient to power the operations of the dispenser 10. The electrical power is configured to activate the controller 24 and operate other structures, such as for example, the pump/valve mechanism 22 within the dispenser 10.

Referring again to FIG. 4, in a next step 74, the distributer determines whether the controller 24 has been programmed with one or more unlock codes. Interaction with the controller 24 can be accomplished via the input device 30, via hand-held module (not shown), by wireless devices or by status indicators contained within the controller 24. If it is determined that the dispenser 10 has been programmed with unlock codes, the distributer enters the unlock codes as shown generally in step 76. After the unlock codes have been entered in step 76, the process proceeds to step 78. Referring again to step 74, if it is determined that the controller 24 has not been programmed with unlock codes, the process proceeds to step 78.

Referring now to step 78 in FIG. 4, the distributer determines whether the dispenser 10 is to be custom programmed, that is, whether the dispenser 10 will have specific locking events programmed into the controller 24. If the distributor desires to program the dispenser 10 to include specific locking events, the process proceeds to the plurality of steps included in the programming mode, collectively identified by reference character 80. If the distributor does not desires to program the dispenser 10 to include specific locking events, the process proceeds to the plurality of steps included in the operation mode, collectively identified by reference character 82.

Referring again to FIG. 4, within the programming mode 80, a first process step is to assign an unlock code 84. The assignment of an unlock code places a user designated unlock code into the memory of the controller 24. Subsequent users desiring to operate the dispenser 10 or reprogram the dispenser 10 are required to enter the newly assigned unlock code. Once the unlock code is assigned at step 84, the distributor can enter specific locking events, shown collectively at step 86. The term "locking events", as used herein, are defined as events that serve to disable the operation of the dispenser 10, unless the designated unlock code is subsequently entered.

Referring again to FIG. 4, one non-limiting example of a specific locking event is the time based locking of the dispenser 10, based on an elapsed time as shown in step 88*a*. The time based locking event provides that operation of the dispenser 10 becomes disabled after a defined or elapsed period of time. A subsequently entered unlocking code re-establishes operation of the dispenser 10 after the defined period of time. In certain embodiments, the defined period of time can be two (2) weeks. However, in other embodiments, the defined period of time can be more or less than two (2) weeks.

Another example of a time based locking event is the locking of the dispenser 10 based an absolute time and/or date, as also shown in step 88*a*. The absolute time based locking event provides that operation of the dispenser 10 becomes disabled at a pre-determined time and/or date. A subsequently entered unlocking code re-establishes operation of the dispenser 10. In certain embodiments, the pre-determined time can be defined as next Tuesday at 10:00 p.m. However, in other embodiments, the pre-determined time and/or date can be other than next Tuesday at 10:00 p.m.

Another example of a specific locking event is the locking of the dispenser 10 based on a dispensed count, as shown in step 88*b*. The count based locking event provides that operation of the dispenser 10 becomes disabled after a defined number of dispenses. A subsequently entered unlocking code re-establishes operation of the dispenser 10 after the defined number of dispenses, as determined by the controller 24. In certain embodiments, the defined number of dispenses can be 500. However, in other embodiments, the defined number of dispenses can be less than or more than 500.

Another example of a specific locking event is the locking of the dispenser 10 based on a command, as shown in step 88*c*. The command based locking event provides that operation of the dispenser 10 becomes disabled after entry of an immediate stop or pause command. A subsequently entered unlocking code re-establishes operation of the dispenser 10 after the immediate stop or pause command. In other embodiments, it is contemplated the stop or pause commands can have a delayed implementation, such as a defined number of dispenses or a defined period of time. One non-limiting example of a delayed implementation is to stop or pause after three dispenses or after ten minutes. It is further contemplated the stop or pause commands can have other desired form or structure sufficient to disable operation of the dispenser 10.

Another example of a specific locking event is the locking of the dispenser 10 based on an open cover 12, as shown in step 88*d*. The open cover based locking event provides that operation of the dispenser 10 becomes disabled in the event the cover 12 is opened. In some instances, the cover 12 is opened to replace the reservoir 20 of dispensing material. In other instances, the cover 12 can be opened to service the pump/valve mechanism 22. In still other instances, the cover 12 can be opened for many other reasons. A subsequently entered unlocking code re-establishes operation of the dispenser 10 after the cover has been opened.

Another example of a specific locking event is the locking of the dispenser 10 based on replacement of the reservoir 20, as shown in step 88*e*. The reservoir replacement based locking event provides that operation of the dispenser 10 becomes disabled after the reservoir 20 of dispensing material is replaced. A subsequently entered unlocking code re-establishes operation of the dispenser 10 after the reservoir 20 of dispensing material is replaced.

While the embodiment illustrated in FIG. 4 provides for the specific locking events 88*a*-88*e*, it should be appreciated that in other embodiments, other specific locking events can be entered and used.

Referring again to FIG. 4, following the steps of entering one or more specific locking events 88*a*-88*e*, in a next step the dispenser 10 is locked as shown by step 90. Locking the dispenser 10 disables operation of the dispenser 10 until the designated unlocking code is entered.

Referring now to FIG. 4 and the operation mode 82, in a next process step 92 the user enters the designated unlocking code. The unlocking code enables operation of the dispenser 10. In the event the user enters an improper unlocking code, the controller 24 will not accept the improper unlocking code and the dispenser 10 will remain in a locked condition.

Referring again to FIG. 4, in a next step 94, a dispensing request is generated by the sensing mechanism 26 of the dispenser 10 and transmitted to the controller 24 as described above. In a subsequent step 96, the controller 24 receives the dispensing request and determines if a previously defined specific locking event 88*a*-88*e* has occurred. If a locking event has occurred, the dispenser 10 is in a disabled state and the user is referred back to step 92, requiring input of an unlock code. If, in step 96, an unlocking event has not occurred, the controller 24 communicates with the pump/valve mechanism 22 and directs the pump/valve mechanism 22 to dispense the dispensing material as shown in step 98.

Referring again to step 96 of FIG. 4, if the controller 24 determines a specific locking event 88*a*-88*e* has occurred, the user is required to enter the designated unlocking code as shown in step 100 to enable operation of the dispenser 10. Once the operation of the dispenser 10 is enabled, the controller 24 communicates with the pump/valve mechanism 22 and directs the pump/valve mechanism 22 to dispense the dispensing material as shown in step 102.

Referring again to FIG. 4, in the instance where a specific locking event 88*a*-88*e* has occurred, an unlocking code 100 has been entered and the dispensing material has been dispensed 102, the event can be recorded in an optional event recorder as shown in step 104. The event recorder can have several forms, including hard copy from a printer, retention in an electronic memory and/or communication via e-mail or messaging methods.

While programming and operation of the programmable locking dispenser 10 is illustrated in FIG. 4 and described above, it should be appreciated that in other embodiments, the programming and operation of the dispenser 10 can be practiced in other manners without departing from the scope of the programmable locking dispenser.

Referring again to FIG. 4, the programming and operation of the dispenser 10 advantageously provides for selectively and electronically locking and unlocking of the dispenser 10 by qualified personnel, thereby selectively enabling or disabling use of the dispenser 10. The programming of the dispenser 10 further provides for input of custom locking codes and selective locking events. Finally, the operation of the dispenser 10 advantageously can provide for documentation of the occurrence of one or more specific locking events.

The principle and mode of operation of the programmable locking dispenser has been described in certain embodiments. However, it should be noted that the programmable locking dispenser may be practiced otherwise than as specifically illustrated and described without departing from its scope.

What is claimed is:

1. A programmable locking dispenser comprising:

a reservoir configured to store dispensing material and release the dispensing material upon demand;

a pump/valve mechanism configured for fluid connection with the reservoir;

an output structure configured for fluid connection with the pump/valve mechanism;

a controller configured to generate and send dispensing signals to the pump/valve mechanism, the controller further configured to store pre-programmed locking events and unlocking codes;

a sensing mechanism configured to generate activation signals upon an occurrence of an activating event and further configured to convey the activation signals to the controller; and an input device configured to receive programming signals and convey the programming signals to the controller;

wherein the controller is further configured to selectively lock and unlock the dispenser such that in a locked mode, the dispenser is disabled from use and in an unlocked mode, the dispenser is enabled for use;

wherein the controller is configured to lock the dispenser upon the occurrence of a specific locking event, the specific locking event being one of an elapsed time, a predetermined date;

wherein the controller is configured to receive user entered unlocking codes while the dispenser is in the locked mode, the controller is configured to compare the user entered unlocking codes with the pre-programmed unlocking codes, and in the event the controller identifies a match of the user entered unlocking codes and the pre-programmed unlocking codes, the controller is configured to unlock the dispenser, thereby enabling the dispenser for use.

2. The programmable locking dispenser of claim 1, wherein the controller is configured to receive programming signals from the input device.

3. The programmable locking dispenser of claim 2, wherein the programming signals received by the controller include locking event and unlocking codes.

4. The programmable locking dispenser of claim 2, wherein the controller is configured to store the received programming signals.

5. The programmable locking dispenser of claim 1, wherein the controller is configured to generate the dispensing signals after confirming the specific locking event has not occurred.

6. The programmable locking dispenser of claim 1, wherein the input device includes a keypad.

7. The programmable locking dispenser of claim 1, wherein the input device is configured to wirelessly receive unlocking and locking event codes.

8. The programmable locking dispenser of claim 1, wherein the input device is configured to receive a mobile storage device having a USB-style connector.

9. The programmable locking dispenser of claim 1, wherein the input device is configured for physical connection to handheld electronic devices.

10. A method of programming and operating a programmable locking dispenser, the programmable locking dispenser including a reservoir, a pump/valve mechanism, an output structure, a controller, a sensing mechanism and an input device, the method comprising the steps of:

shipping the dispenser in an unlocked mode to enable input of unlocking codes and specific locking events;

providing programming signals to an input device;

conveying the programming signals from the input device to a controller;

programming the controller to include unlocking codes and specific locking events, thereby forming pre-programmed unlocking codes and pre-programmed specific locking events;

locking of the dispenser to disable use following the occurrence of a pre-programmed specific locking event, wherein the specific locking event is an open dispenser cover;

unlocking the dispenser after the controller, which is configured to compare user entered unlocking codes with the pre-programmed unlocking codes, identifies a match, thereby enabling the dispenser for use.

11. The method of claim 10, including the step of the controller receiving programming signals from the input device.

12. The method of claim 10, including the step of the controller storing the received programming signals.

13. The method of claim 10, including the step of the controller generating the dispensing signals after confirming the specific locking event has not occurred.

14. The method of claim 10, wherein the input device includes a keypad.

15. The method of claim 10, including the step of the input device wirelessly receiving the unlocking and locking event codes.

16. A programmable locking dispenser comprising:

a reservoir configured to store dispensing material and release the dispensing material upon demand;

a pump/valve mechanism configured for fluid connection with the reservoir;

an output structure configured for fluid connection with the pump/valve mechanism;

a controller configured to generate and send dispensing signals to the pump/valve mechanism, the controller further configured to store pre-programmed locking events and unlocking codes;

a sensing mechanism configured to generate activation signals upon an occurrence of an activating event and further configured to convey the activation signals to the controller; and an input device configured to receive programming signals and convey the programming signals to the controller;

wherein the controller is further configured to selectively lock and unlock the dispenser such that in a locked mode, the dispenser is disabled from use and in an unlocked mode, the dispenser is enabled for use;

wherein the controller is configured to lock the dispenser upon the occurrence of a specific locking event, the specific locking event being a predetermined time;

wherein the controller is configured to receive user entered unlocking codes while the dispenser is in the locked mode, the controller is configured to compare the user entered unlocking codes with the pre-programmed unlocking codes, and in the event the controller identifies a match of the user entered unlocking codes and the pre-programmed unlocking codes, the controller is configured to unlock the dispenser, thereby enabling the dispenser for use.

17. A programmable locking dispenser comprising:

a reservoir configured to store dispensing material and release the dispensing material upon demand;

a pump/valve mechanism configured for fluid connection with the reservoir;

an output structure configured for fluid connection with the pump/valve mechanism;

a controller configured to generate and send dispensing signals to the pump/valve mechanism, the controller further configured to store pre-programmed locking events and unlocking codes;

a sensing mechanism configured to generate activation signals upon an occurrence of an activating event and further configured to convey the activation signals to the controller; and an input device configured to receive programming signals and convey the programming signals to the controller;

wherein the controller is further configured to selectively lock and unlock the dispenser such that in a locked mode, the dispenser is disabled from use and in an unlocked mode, the dispenser is enabled for use;

wherein the controller is configured to lock the dispenser upon the occurrence of a specific locking event, the specific locking event being replacement of a reservoir of dispensing material;

wherein the controller is configured to receive user entered unlocking codes while the dispenser is in the locked mode, the controller is configured to compare the user entered unlocking codes with the pre-programmed unlocking codes, and in the event the controller identifies a match of the user entered unlocking codes and the pre-programmed unlocking codes, the controller is configured to unlock the dispenser, thereby enabling the dispenser for use.

* * * * *